US007386984B2

(12) United States Patent
Zhang et al.

(10) Patent No.: US 7,386,984 B2
(45) Date of Patent: Jun. 17, 2008

(54) REFRIGERATOR

(75) Inventors: Hengliang Zhang, Yamatotakada (JP); Masaaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 373 days.

(21) Appl. No.: 10/559,667

(22) PCT Filed: Jun. 8, 2004

(86) PCT No.: PCT/JP2004/007959

§ 371 (c)(1),
(2), (4) Date: Dec. 6, 2005

(87) PCT Pub. No.: WO2004/113804

PCT Pub. Date: Dec. 29, 2004

(65) Prior Publication Data

US 2006/0144053 A1 Jul. 6, 2006

(30) Foreign Application Priority Data

Jun. 23, 2003 (JP) ..... 2003-178132

(51) Int. Cl.
*F25B 9/00* (2006.01)
*F25B 7/00* (2006.01)
*F25D 17/00* (2006.01)
*F25D 11/02* (2006.01)

(52) U.S. Cl. ..... 62/6; 62/333; 62/335; 62/441

(58) Field of Classification Search ..... 62/6, 62/333, 335, 441
See application file for complete search history.

(56) References Cited

U.S. PATENT DOCUMENTS 2,581,044 A * 1/1952 Ratcliff ..... 62/149
5,284,022 A * 2/1994 Chung ..... 62/6
5,317,878 A * 6/1994 Bradshaw et al. ..... 62/6
5,642,622 A * 7/1997 Berchowitz et al. ..... 62/6
5,664,421 A * 9/1997 Matsue et al. ..... 62/6
5,927,079 A * 7/1999 Sekiya et al. ..... 62/6
6,698,210 B2 * 3/2004 Ogura et al. ..... 62/6
6,931,863 B2 * 8/2005 Chen et al. ..... 62/6
2003/0010039 A1 * 1/2003 Maguire et al. ..... 62/6
2005/0016184 A1 * 1/2005 Zhang et al. ..... 62/6
2005/0172644 A1 * 8/2005 Zhang et al. ..... 62/6

FOREIGN PATENT DOCUMENTS

JP 2000-18748 A 1/2000

(Continued)

OTHER PUBLICATIONS

Office Action Dated Sep. 27, 2005 issued in basic Japanese Patent Application No. 2003-178132 with English Translation.

*Primary Examiner*—William C Doerrler
(74) *Attorney, Agent, or Firm*—Birch, Stewart, Kolasch & Birch, LLP

(57) ABSTRACT

A refrigerator includes a Stirling refrigerating machine having a high-temperature heat radiation portion and a low-temperature heat absorption portion and for cooling a freezing compartment, and a compressor for circulating a first refrigerant through a first circulation circuit having a cooling compartment evaporator. The high-temperature heat radiation portion is in contact with a first circulation spiral portion formed in the first circulation circuit.

12 Claims, 4 Drawing Sheets

FOREIGN PATENT DOCUMENTS

| | | | |
|---|---|---|---|
| JP | 2000-221384 | A | 8/2000 |
| JP | 2000-337747 | A | 12/2000 |
| JP | 2002-71237 | A | 3/2002 |
| JP | 2004-20056 | A | 1/2004 |
| JP | 2004-101050 | A | 4/2004 |

* cited by examiner

REFRIGERATOR

TECHNICAL FIELD

The present invention relates to a refrigerator incorporating a Stirling refrigerating machine and a compressor.

BACKGROUND ART

A conventional refrigerator employs a refrigeration cycle using a compressor. The compressor is used for condensing a working refrigerant in the refrigeration cycle. The condensed working refrigerant is reduced in pressure and expanded in an expansion portion, and is delivered to an evaporator. The evaporator attains a low temperature as the working refrigerant evaporates therein. The evaporator is arranged inside the refrigerator, and the interior of the refrigerator is maintained at a low temperature by the evaporator. For the working refrigerant, an alternative refrigerant (HFC refrigerant) or hydrocarbon (HC refrigerant) is used.

A refrigerator provided with a Stirling refrigerating machine using a reversed Stirling cycle instead of the refrigeration cycle using the compressor has been proposed (e.g., Japanese Patent Laying-Open No. 2000-18748). A refrigerator incorporating both the Stirling refrigerating machine and the compressor has been proposed as well.

FIG. 4 is a schematic cross sectional view of a refrigerator incorporating a Stirling refrigerating machine and a compressor that is disclosed in Japanese Patent Laying-Open No. 2000-337747. The refrigerator is partitioned into a cooling compartment 21 and a freezing compartment 22, with freezing compartment 22 being arranged on the upper side and cooling compartment 21 being arranged on the lower side. A compressor 11 is arranged in the back at the bottom of cooling compartment 21. The refrigerant compressed by compressor 11 is delivered via a first circulation circuit 5 to a heat exchanger 29. Cooling and expansion of the refrigerant take place (not shown) between compressor 11 and heat exchanger 29. The refrigerant having reached heat exchanger 29 is evaporated within heat exchanger 29, which cools heat exchanger 29 by latent heat. The refrigerant having been evaporated in the cooling compartment evaporator is returned via first circulation circuit 5 to compressor 11, where it is compressed again.

At the back of cooling compartment 21, a cooling compartment circulation path 8 is formed for circulation of the air in cooling compartment 21. Heat exchanger 29 is arranged inside cooling compartment circulation path 8. Also arranged in cooling compartment circulation path 8 is a cooling compartment cooling fan 23. As cooling compartment cooling fan 23 is driven, the air flow occurs inside cooling compartment circulation path 8. In FIG. 4, the air in cooling compartment 21 enters cooling compartment circulation path 8 from the lower side and is released into cooling compartment 21 from an outlet formed in cooling compartment circulation path 8. The air within cooling compartment 21 is cooled as it comes into contact with heat exchanger 29 when passing through cooling compartment circulation path 8. The air coming out of cooling compartment circulation path 8 has been cooled and is of a low temperature. This air flow cools the items stored in cooling compartment 21.

Stirling refrigerating machine 1 is arranged in the back at the top of the refrigerator. Stirling refrigerating machine 1 is a device in which a piston performs a reciprocating motion inside the cylinder, which causes the working refrigerant to move between a compression space and an expansion space to thereby repeat compression and expansion. As the working refrigerant, helium gas, hydrogen gas, nitrogen gas or the like is filled therein. The working refrigerant compressed in the compression space is at a high temperature, which is cooled by the outside air at a high-temperature heat radiation portion 2. The cooled working refrigerant is expanded as it is transferred to the expansion space. The working refrigerant attains a low temperature as it is expanded in the expansion space. The working refrigerant of a low temperature cools a low-temperature heat absorption portion 3. Low-temperature heat absorption portion 3 is formed such that a part thereof is exposed to freezing compartment 22. Freezing compartment 22 is cooled by low-temperature heat absorption portion 3.

In the refrigerator shown in FIG. 4, cooling compartment circulation path 8 extends to the top portion of the refrigerator where Stirling refrigerating machine 1 is arranged. Further, a blower fan 25 is arranged to deliver the cool air toward the top portion of the refrigerator. This refrigerator is configured such that driving of bower fan 25 can deliver a part of the air cooled by heat exchanger 29 to the high-temperature heat radiation portion of the Stirling refrigerating machine. High-temperature heat radiation portion 2 is cooled by this air of a low temperature. The air having cooled high-temperature heat radiation portion 2 is externally discharged via an exhaust vent 26 formed on the backside of the refrigerator.

Since this refrigerator has freezing compartment 22 cooled by Stirling refrigerating machine 1 and cooling compartment 22 cooled by heat exchanger 29, the respective compartments can be used in accordance with the intended use, so that a refrigerator of high usability is obtained. Further, the air in cooling compartment circulation path 8 having been cooled by heat exchanger 29 can cool high-temperature heat radiation portion 2 of Stirling refrigerating machine 1, and as a result, cooling efficiency of Stirling refrigerating machine 1 is improved.

Patent Document 1: Japanese Patent Laying-Open No. 2000-18748 (pages 4-5, and FIGS. 1-6)

Patent Document 2: Japanese Patent Laying-Open No. 2000-337747 (pages 3-4, and FIGS. 1-2)

DISCLOSURE OF THE INVENTION

Problems to be Solved by the Invention

In a refrigerator using only the refrigeration cycle by the compressor, when the refrigeration cycle attains a temperature in the cryogenic temperature range of −30° C. or lower, cooling capacity is considerably decreased as the specific volume and the compression ratio of the refrigerant vapor increase. As such, it is difficult to employ it as a refrigerator performing cryogenic refrigeration.

Although a refrigerator incorporating only the Stirling refrigerating machine can handle the refrigeration in the cryogenic temperature range, using the cold air of −30° C. or lower for cooling the cooling compartment of 0° C. to 5° C. would increase power consumption of the refrigerator as a whole. Further, unlike the case of the refrigerator using the refrigeration cycle by the compressor, it would be difficult to utilize the heat of the high-temperature heat radiation portion of the Stirling refrigerating machine directly for preventing formation of dew condensation at the door gasket of the refrigerator or for treatment of the drain water. Although the heat of the high-temperature heat radiation portion of the Stirling refrigerating machine may be utilized for heating the door gasket or the drain pan using a heat pipe or a secondary refrigerant circulation pump, system COP (energy consumption efficiency: Coefficient of Performance) will be degraded due to poor heat exchange efficiency.

Meanwhile, in the refrigerator disclosed in Japanese Patent Laying-Open No. 2000-337747, the air of a low temperature-having been generated in the refrigeration cycle by the compressor is utilized directly for cooling the high-temperature heat radiation portion of the Stirling refrigerating machine, to thereby improve cooling efficiency of the high-temperature heat radiation portion of the Stirling refrigerating machine. This refrigerator however is poor in efficiency of heat exchange since the heat-transfer coefficient of the air is low. The cold air would be released to the environment in a large amount, leading to degradation of the system COP. Further, since the air is cooled at the heat exchanger in the refrigeration cycle using the compressor and the cooled air is then used to cool the high-temperature heat radiation portion of the Stirling refrigerating machine, it takes time until the temperature of the high-temperature heat radiation portion of the Stirling refrigerating machine is lowered, which is unsuitable for quick cooling of the freezing compartment.

The present invention has been made to solve the above-described problems, and an object of the present invention is to provide a refrigerator capable of cryogenic refrigeration with low power consumption.

Means for Solving the Problems

A refrigerator according to the present invention includes a Stirling refrigerating machine having a high-temperature heat radiation portion and a low-temperature heat absorption portion and cooling a freezing compartment, and a compressor for circulating a first refrigerant through a first circulation circuit including a cooling compartment evaporator. The high-temperature heat radiation portion is in contact with the first circulation circuit. With this configuration, it is possible to efficiently cool the high-temperature heat radiation portion of the Stirling refrigerating machine, and thus to provide a refrigerator capable of cryogenic refrigeration with low power consumption.

In the above invention, preferably, the high-temperature heat radiation portion is in contact with piping of the first circulation circuit on its way from the cooling compartment evaporator back to the compressor. With this configuration, it is possible to cause the high-temperature heat radiation portion to come into contact with the first circulation circuit with a simple configuration.

In the above invention, preferably, the high-temperature heat radiation portion is in contact with a heat radiation portion cooling evaporator that is formed in the first circulation circuit on its way from the cooling compartment evaporator back to the compressor. With this configuration, it is possible to enlarge the contact area between the high-temperature heat radiation portion and the first circulation circuit, and thus to cool the high-temperature heat radiation portion more efficiently.

In the above invention, preferably, a cooling compartment cooling fan is provided for transferring cold heat of the cooling compartment evaporator to a cooling compartment, and control means is also provided for stopping the cooling compartment cooling fan when detecting that a temperature of the freezing compartment has become a set value or higher. With this configuration, it is possible to quickly cool the freezing compartment even if the temperature of the freezing compartment becomes high.

In the above invention, preferably, the first circulation circuit includes a main circuit and an auxiliary circuit. The auxiliary circuit has an auxiliary refrigerant expansion portion and a heat radiation portion cooling evaporator that is formed downstream of the auxiliary refrigerant expansion portion, and has its inlet connected to branch means that is formed in piping of the main circuit on its way from the compressor to the cooling compartment evaporator. The high-temperature heat radiation portion is in contact with the heat radiation portion cooling evaporator. With this configuration, it is possible to use a part of the first refrigerant for cooling the high-temperature heat radiation portion, and thus to cool the high-temperature heat radiation portion more efficiently.

In the above invention, preferably, a three-way valve capable of opening/closing its side directed to the cooling compartment evaporator and its side directed to the heat radiation portion cooling evaporator is arranged as the branch means. With this configuration, the branch means can readily be formed. Further, it is possible to block the first refrigerant going toward the cooling compartment evaporator or the first refrigerant going toward the heat radiation portion cooling evaporator as required, which leads to saving of power consumption.

In the above invention, preferably, control means is provided for closing the side of the three-way valve directed to the cooling compartment evaporator when detecting that a temperature of the cooling compartment has become a set value or lower. With this configuration, when it is unnecessary to cool the cooling compartment, the flow of the first refrigerant toward a cooling compartment evaporator can be blocked to save power consumption.

In the above invention, preferably, control means is provided for closing the side of the three-way valve directed to the heat radiation portion cooling evaporator when detecting that a temperature of the freezing compartment has become a set value or lower. With this configuration, when it is unnecessary to cool the freezing compartment, the flow of the first refrigerant toward the heat radiation portion cooling evaporator can be blocked to save power consumption.

In the above invention, preferably, control means is provided for closing the side of the three-way valve directed to the cooling compartment evaporator and opening the side of the three-way valve directed to the heat radiation portion cooling evaporator when detecting that a temperature of the freezing compartment has become a set value or higher. With this configuration, it is possible to increase the cooling capacity of the heat radiation portion cooling evaporator, to thereby quickly cool the freezing compartment.

In the above invention, preferably, a cooling compartment cooling fan is provided for transferring cold heat of the cooling compartment evaporator to a cooling compartment, and control means is provided for causing the cooling compartment cooling fan to rotate by detecting humidity of the cooling compartment in the state where the side of the three-way valve directed to the cooling compartment evaporator is closed. With this configuration, it is possible to evaporate the frost settled around the cooling compartment evaporator, to thereby maintain sufficiently high humidity in the cooling compartment.

In the above invention, preferably, control means is provided for decreasing the number of revolutions of the compressor and increasing output of the Stirling refrigerating machine when detecting that a temperature of the cooling compartment evaporator has become a set value or lower. With this configuration, it is possible to remove the frost formed around the cooling compartment evaporator, which eliminates the need of a defrosting heater otherwise provided around the cooling compartment evaporator. This simplifies the device configuration, and can save power consumption as well.

In the above invention, preferably, control means is provided for controlling the number of revolutions of the compressor in response to an outside air temperature and a temperature of a cooling compartment. With this configuration, it is possible to suppress an operation of the compressor in the state where excessive load is involved, which contributes to saving of power consumption.

Effects of the Invention

According to the present invention, it is possible to provide a refrigerator consuming low power and capable of cryogenic refrigeration, which can efficiently cool a high-temperature heat radiation portion of a Stirling refrigerating machine.

Further, it is possible to provide a refrigerator ensuring high power output even when a low-temperature heat absorption portion of the Stirling refrigerating machine is in a cryogenic state, and enabling long-lasting cryogenic cooling of the freezing compartment as well as quick refrigeration of the freezing compartment.

DESCRIPTION OF THE REFERENCE SIGNS

1: Stirling refrigerating machine; 2: high-temperature heat radiation portion; 3: low-temperature heat absorption portion; 4: freezing compartment evaporator; 5: first circulation circuit; 6: second circulation circuit; 7*a*: main circuit; 7*b* : auxiliary circuit; 8: cooling compartment circulation path; 9: freezing compartment circulation path; 11: compressor; 12: cooling compartment evaporator; 13*a*: refrigerant expansion portion; 13*b*: auxiliary refrigerant expansion portion; 14: drain treatment refrigerant pipe; 15: dew condensation preventing refrigerant pipe; 16: refrigerant condensation pipe; 17: first circulation spiral portion; 18: second circulation spiral portion; 19: heat radiation portion cooling evaporator; 20: three-way valve; 21: cooling compartment; 22: freezing compartment; 23: cooling compartment cooling fan; 24: freezing compartment cooling fan; 25: blower fan; 26: exhaust vent; 27, 28: partition; and 29: heat exchanger.

BEST MODES FOR CARRYING OUT THE INVENTION

A refrigerator according to a first embodiment of the present invention will now be described with reference to FIGS. 1 and 2.

Figure 1:
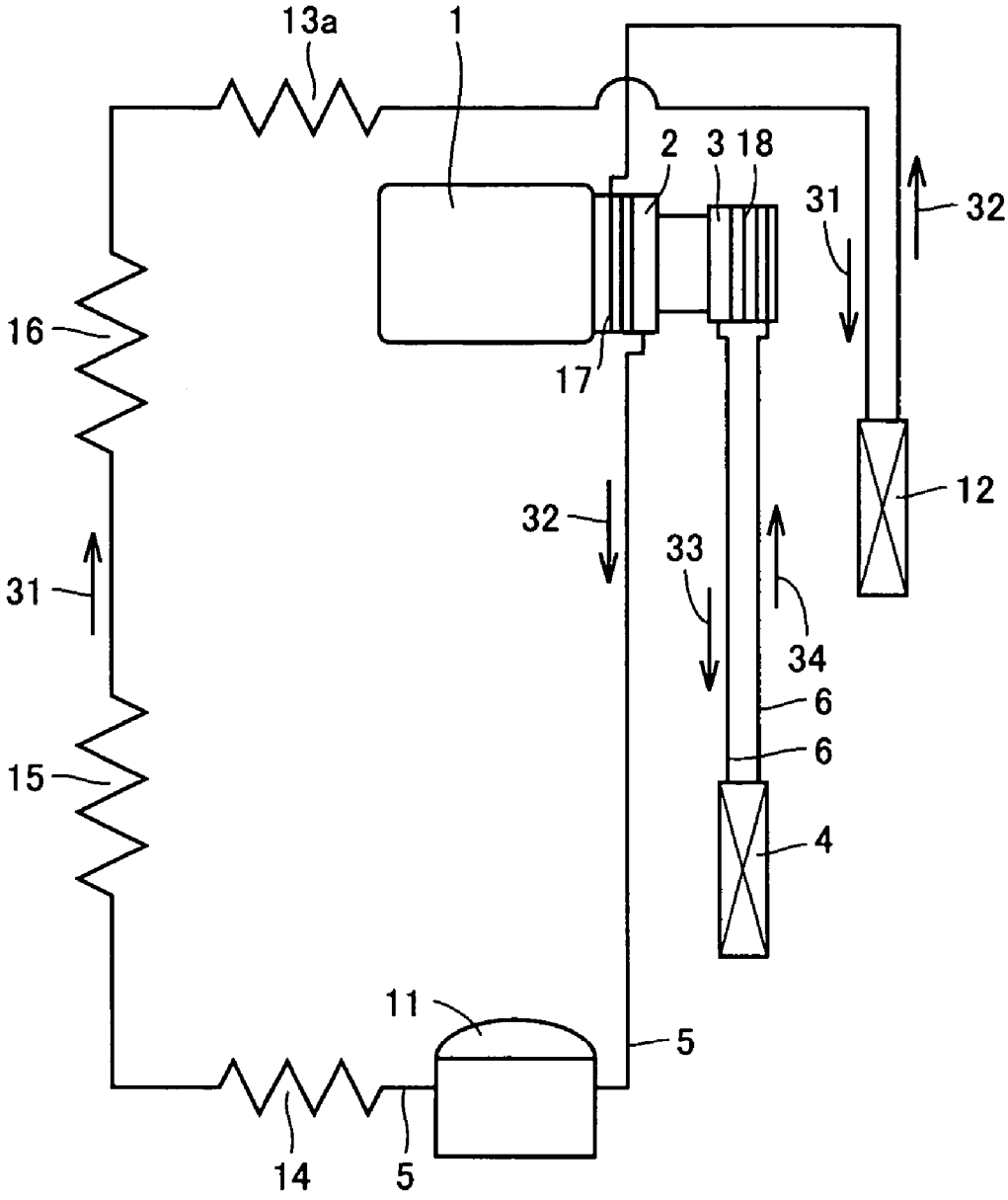
FIG. 1 illustrates a cooling circuit of a refrigerator according to a first embodiment of the present invention.

FIG. 1 illustrates a cooling circuit of the refrigerator of the present embodiment. The refrigerator is provided with a refrigeration cycle including a compressor 11, and a Stirling refrigerating machine 1. The cooling circuit includes a first circulation circuit 5 and a second circulation circuit 6. HC refrigerant as the first refrigerant is filled in first circulation circuit 5, while carbon dioxide as the second refrigerant is filled in second circulation circuit 6.

First circulation circuit 5 is configured such that the first refrigerant is compressed by compressor 11, delivered to a cooling compartment evaporator 12 as shown by an arrow 31, and returned to compressor 11 via a first circulation spiral portion 17 as shown by an arrow 32. Stirling refrigerating machine 1 includes a high-temperature heat radiation portion 2 and a low-temperature heat absorption portion 3, and helium, nitrogen or hydrogen gas is sealed therein. Second circulation circuit 6 is formed to come into contact with low-temperature heat absorption portion 3 at a second circulation spiral portion 18, and is configured such that the second refrigerant is sent to a freezing compartment evaporator 4 as shown by an arrow 33, and then returned to second circulation spiral portion 18 as shown by an arrow 34.

In first circulation circuit 5, a drain treatment refrigerant pipe 14, a dew condensation preventing refrigerant pipe 15, a refrigerant condensation pipe 16, and a refrigerant expansion portion 13 a are connected in series between the outlet of compressor 11 and the inlet of cooling compartment evaporator 12. For refrigerant expansion portion 13*a,* a capillary tube (tubule), an expansion valve or the like may be employed. A first circulation spiral portion 17 is formed between the outlet of cooling compartment evaporator 12 and the inlet of compressor 11, which is made of the piping of first circulation circuit 5 wound in a spiral manner. First circulation spiral portion 17 is formed to surround high-temperature heat radiation portion 2 of Stirling refrigerating machine 1 to come into contact therewith. Second circulation spiral portion 18 of second circulation circuit 6 is formed around low-temperature heat absorption portion 3 of Stirling refrigerating machine 1 to come into contact with low-pressure heat absorption portion 3.

Figure 2:
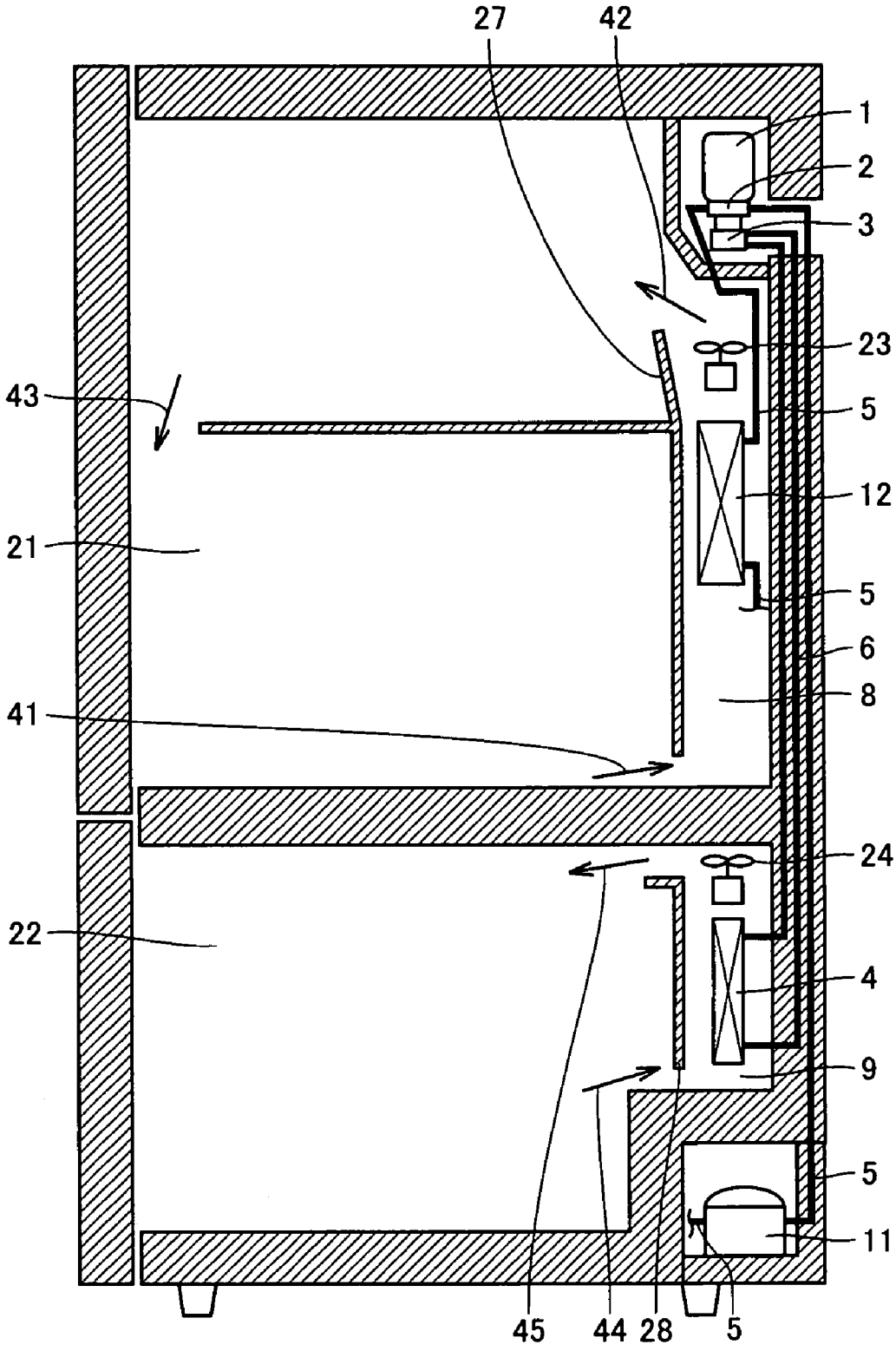
FIG. 2 is a schematic cross sectional view of the refrigerator according to the first embodiment of the present invention.

FIG. 2 is a schematic cross sectional view of the refrigerator of the present embodiment. The refrigerator of the present embodiment has a cooling compartment 21 and a freezing compartment 22, with cooling compartment 21 on the upper side and freezing compartment 22 on the lower side. Compressor 11 is arranged at the lower part in the back of the refrigerator. Stirling refrigerating machine 1 is arranged at the upper part in the back of the refrigerator. Stirling refrigerating machine 1 is arranged isolated from cooling compartment 21. A partition 28 is arranged at the back of freezing compartment 22 to form a freezing compartment circulation path 9. A freezing compartment evaporator 4 and a freezing compartment cooling fan 24 are arranged inside freezing compartment circulation path 9. A partition 27 is arranged at the back of cooling compartment 21 to form a cooling compartment circulation path 8. Partition 27 also divides cooling compartment 21 into an upper part and a lower part. A cooling compartment evaporator 12 and a cooling compartment cooling fan 23 are arranged inside cooling compartment circulation path 8.

First circulation circuit 5 connected to compressor 11 is passed through the bottom part of the refrigerator and is guided frontward of the refrigerator. First circulation circuit 5 guided frontward is then passed through the inside of a side panel formed on the side face of the refrigerator, and is guided again to the back part, where it is connected to the inlet of cooling compartment evaporator 12. The drain treatment refrigerant pipe (not shown) is placed at the bottom part of the refrigerator. The condensation preventing refrigerant pipe (not shown) is placed around the opening of the refrigerator. The refrigerant condensation pipe (not shown) is placed inside the side panel, attached thereto in a meandering pattern. The refrigerant expansion portion (not shown) is formed of a capillary tube, which is placed between the refrigerant condensation pipe and cooling compartment evaporator 12. First circulation circuit 5 connected to the outlet of cooling compartment evaporator 12 is configured such that it returns to compressor 11 via first circulation spiral portion 17 (see FIG. 1) in contact with high-temperature heat radiation portion 2 of Stirling refrigerating machine 1 that is arranged at the upper part.

Second circulation circuit 6 is formed at the back part of the refrigerator. Second circulation circuit 6 having come out of second circulation spiral portion 18 (see FIG. 1) in contact with low-temperature heat absorption portion 3 of Stirling refrigerating machine 1 is connected to the inlet of freezing compartment evaporator 4 that is arranged in freezing compartment circulation path 9. Second circulation circuit 6 connected to the outlet of freezing compartment evaporator 4 is connected to the inlet of second circulation spiral portion 18 (see FIG. 1).

The first refrigerant coming out of compressor 11 is passed through drain treatment refrigerant pipe 14, dew condensation preventing refrigerant pipe 15 and refrigerant condensation pipe 16, and delivered to refrigerant expansion portion 13*a*. The first refrigerant condensed in compressor 11 has its temperature increased, which is cooled as it is passed through drain treatment refrigerant pipe 14, dew condensation preventing refrigerant pipe 15 and refrigerant condensation pipe 16. Drain treatment refrigerant pipe 14 serves to evaporate the drain water of the refrigerator, while dew condensation preventing refrigerant pipe 15 prevents formation of dew condensation at the door gasket and the peripheral portion of the refrigerator. Refrigerant condensation pipe 16 releases the heat of the first refrigerant to the outside of the refrigerator via the side panel of the refrigerator. With such heat exchange, the first refrigerant is cooled and condensed before it reaches refrigerant expansion portion 13*a*. In the present embodiment, the heat radiation pipes are formed in straight lines connected in series, for simplification of explanation. Not limited thereto, they may each include a parallel circuit having curved portions, or more than one pipe or parallel circuit may be formed.

The first refrigerant cooled while flowing through first circulation circuit 5 is reduced in pressure and expanded in refrigerant expansion portion 13*a*, and is delivered to cooling compartment evaporator 12 in the two-phase state. Cooling compartment evaporator 12 attains a low temperature by latent heat as the first refrigerant evaporates. The first refrigerant coming out of cooling compartment evaporator 12 is delivered to first circulation spiral portion 17 as shown by an arrow 32 in FIG. 1. High-temperature heat radiation portion 2 of Stirling refrigerating machine 1 is cooled as first circulation spiral portion 17 is in contact with high-temperature heat radiation portion 2. Thereafter, the first refrigerant is returned to compressor 11, where it is compressed again.

When compressor 11 starts operation, the first refrigerant inside first circulation circuit 5 begins to circulate, and cooling compartment evaporator 12 attains a low temperature. The air flow shown by arrows 41, 42 and 43 is generated as cooling compartment cooling fan 23 is driven. The air in cooling compartment 21 flows into cooling compartment circulation path 8, where it is cooled by cooling compartment evaporator 12 and then returned to cooling compartment 21. In the present embodiment, cooling compartment 21 is separated into the upper part and the lower part by partition 27. Thus, in cooling compartment 21, the air flow occurs from the upper rack to the lower rack of cooling compartment 21 as shown by arrow 43. As such, the air cooled by cooling compartment evaporator 12 is circulated inside cooling compartment 21 to thereby cool the whole area inside cooling compartment 21.

Meanwhile, Stirling refrigerating machine 1 is activated to cool freezing compartment 22. When Stirling refrigerating machine 1 is activated, the temperature of high-temperature heat radiation portion 2 increases, while the temperature of low-temperature heat absorption portion 3 decreases. Second circulation spiral portion 18 (see FIG. 1) formed around low-temperature heat absorption portion 3 is cooled, and the second refrigerant therein is condensed. The second refrigerant flows downward to freezing compartment evaporator 4 arranged at the lower part. The second refrigerant having flown into freezing compartment evaporator 4 is evaporated therein, which causes freezing compartment evaporator 4 to reach a low temperature. The second refrigerant coming out of freezing compartment evaporator 4 moves toward second circulation spiral portion 18 formed on the upper side in the vertical direction by the process of natural circulation, where it is again cooled and condensed. As such, the second refrigerant circulates inside second circulation circuit 6 to lower the temperature of freezing compartment evaporator 4.

As freezing compartment cooling fan 24 is driven, the air in the freezing compartment flows into freezing compartment circulation path 9 as shown by an arrow 44. The air flowing in performs heat exchange with freezing compartment evaporator 4, so that it becomes the air of a low temperature. Thereafter, it is released to the inside of freezing compartment 22 as shown by an arrow 45. This cools the inside of freezing compartment 22 to allow it to maintain the cryogenic state.

As Stirling refrigerating machine 1 is driven, the temperature of high-temperature heat radiation portion 2 increases. In the refrigerator of the present embodiment, high-temperature heat radiation portion 2 is in contact with the piping of first circulation circuit 5 on its way from cooling compartment evaporator 12 back to compressor 11. With this configuration, it is possible to forcibly cool high-temperature heat radiation portion 2 with the cold heat of first circulation circuit 5, and thus, heat exchange can be performed quickly and efficiently. As a result, power consumption of Stirling refrigerating machine 1 can be lowered, and the system COP can be improved. Further, high power output can be obtained even if the low-temperature heat absorption portion of the Stirling refrigerating machine is in the cryogenic state, and the cryogenic cooling of the freezing compartment can be maintained for a long period of time.

In the present embodiment, first circulation spiral portion 17 (see FIG. 1) is formed at the contact portion between high-temperature heat radiation portion 2 and first circulation circuit 5. The configuration however is not specifically limited thereto. All that is needed is that first circulation circuit 5 and high-temperature heat radiation portion 2 are in contact with each other over a large area. Alternatively, first circulation spiral portion 17 may be replaced with an evaporator, where the first refrigerant may be evaporated again to cool high-temperature heat radiation portion 2 by latent heat thereof That is, a heat radiation portion cooling evaporator may be formed around high-temperature heat radiation portion 2 to come into contact therewith. By forming the evaporator, heat exchange with high-temperature heat radiation portion 2 can be performed efficiently. Further, the contact area with high-temperature heat radiation portion 2 can be made large, which improves efficiency of heat exchange.

In the present embodiment, second circulation spiral portion 18 (see FIG. 1) is formed at the contact portion between low-temperature heat absorption portion 3 and second circulation circuit 6. The configuration however is not specifically limited thereto. All that is needed is that heat exchange is enabled between low-temperature heat absorption portion 3 and second circulation circuit 6. For example, in place of second circulation spiral portion 18, a condenser may be provided in close contact with low-temperature heat absorption portion 3. By forming the condenser, heat exchange with low-temperature heat absorption portion 3 can be performed efficiently. Alternatively, in the second circulation circuit, the piping or the freezing compartment evaporator may be replaced with heat transfer means such as a heat pipe or a heat sink.

The refrigerator of the present embodiment is provided with control means for stopping cooling compartment cooling fan 23 when detecting that the temperature of freezing compartment 22 has become a preset value or greater. For example, assume that there is a necessity to rapidly cool freezing compartment 22 since the temperature of freezing compartment 22 has increased because of the door of freezing compartment 22 left open for a long period of time. In such a case, the temperature of freezing compartment 22 is detected and cooling compartment cooling fan 23 is stopped. Heat exchange around cooling compartment evaporator 12 becomes dependent on natural convection, which means less frequent heat exchange. As a result, the temperature of first circulation circuit 5 as a whole decreases, and high-temperature heat radiation portion 2 of Stirling refrigerating machine 1 can be cooled more powerfully in first circulation spiral portion 17. Accordingly, it is possible to increase cooling capacity of low-temperature heat absorption portion 3, to enable rapid cooling of the inside of freezing compartment 22.

Further, the refrigerator of the present embodiment is provided with control means for lowering the number of revolutions of compressor 11 and for increasing the output of Stirling refrigerating machine 1 when detecting that the temperature of cooling compartment evaporator 12 has become a preset value or lower. When the temperature of cooling compartment evaporator 12 becomes too low, there occurs frost around cooling compartment evaporator 12. In such a case, the temperature of the first refrigerant in first circulation circuit 5 increases when the number of revolutions of compressor 11 is lowered. As such, the temperature of cooling compartment evaporator 12 increases as well. In addition, when the output of Stirling refrigerating machine 1 increases, the temperature of high-temperature heat radiation portion 2, as well as the temperature of first circulation spiral portion 17 increases. That is, increasing the output of the Stirling refrigerating machine can accelerate the increase in temperature of the first refrigerant. By providing such control means, the frost formed around cooling compartment evaporator 12 can be removed. As a result, a defrosting heater having conventionally been attached to cooling compartment evaporator 12 becomes unnecessary. This can simplify the device configuration and also save power consumption.

Further, the refrigerator of the present embodiment includes means for detecting the outside air temperature (the ambient temperature around the refrigerator) and the temperature of the cooling compartment, and for controlling the number of revolutions of the compressor in accordance with the outside air temperature and the temperature of the cooling compartment. With this configuration, cooling can be carried out efficiently, which contributes to saving of power consumption.

In the present embodiment, the HC refrigerant is used for the first refrigerant, and carbon dioxide is used for the second refrigerant. Using these refrigerants, the refrigerator according to the present invention can be provided without using chlorofluorocarbon that may destroy the global environment.

Figure 3:
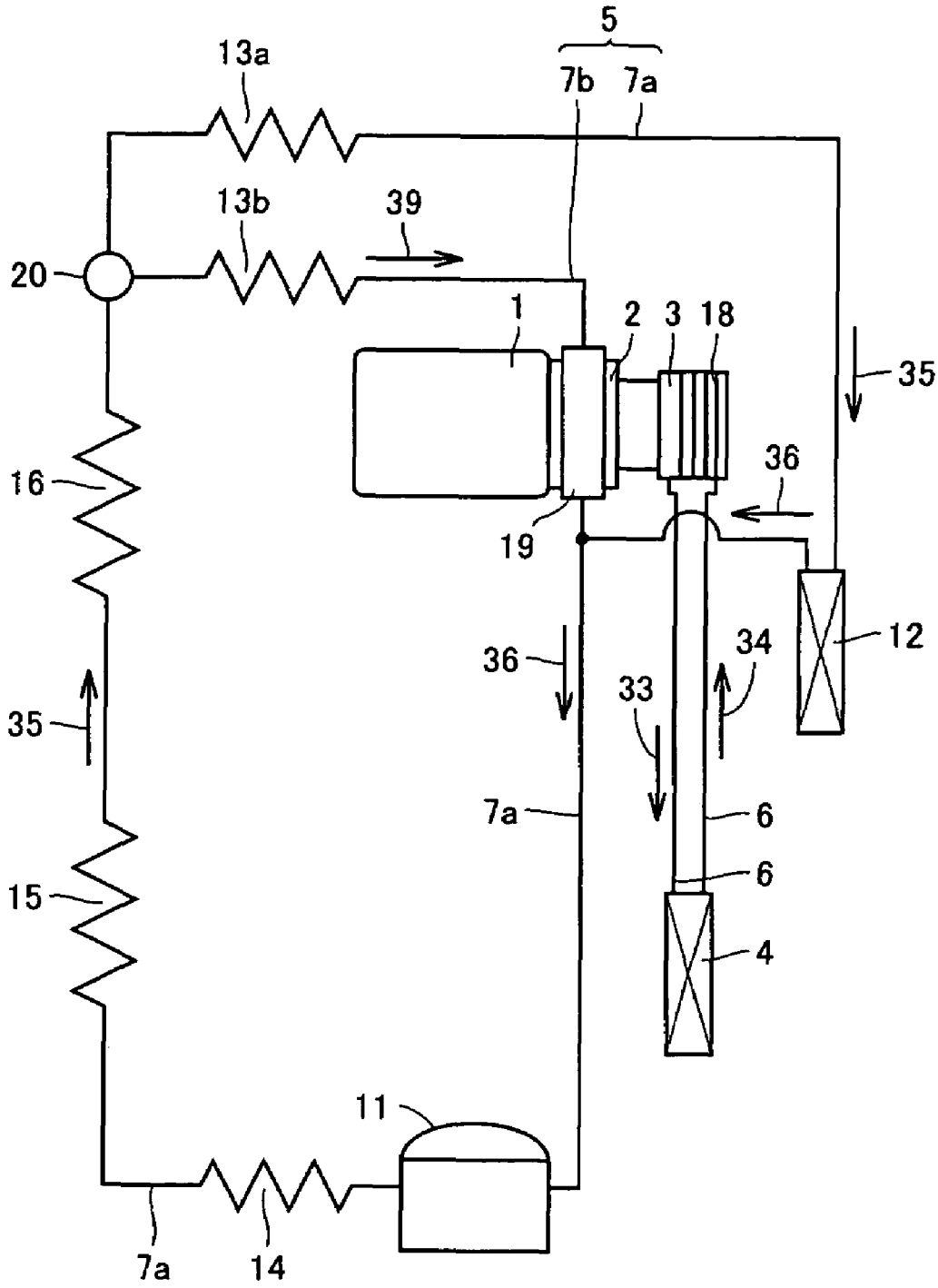
FIG. 3 illustrates a cooling circuit of a refrigerator according to a second embodiment of the present invention.
Figure 4:
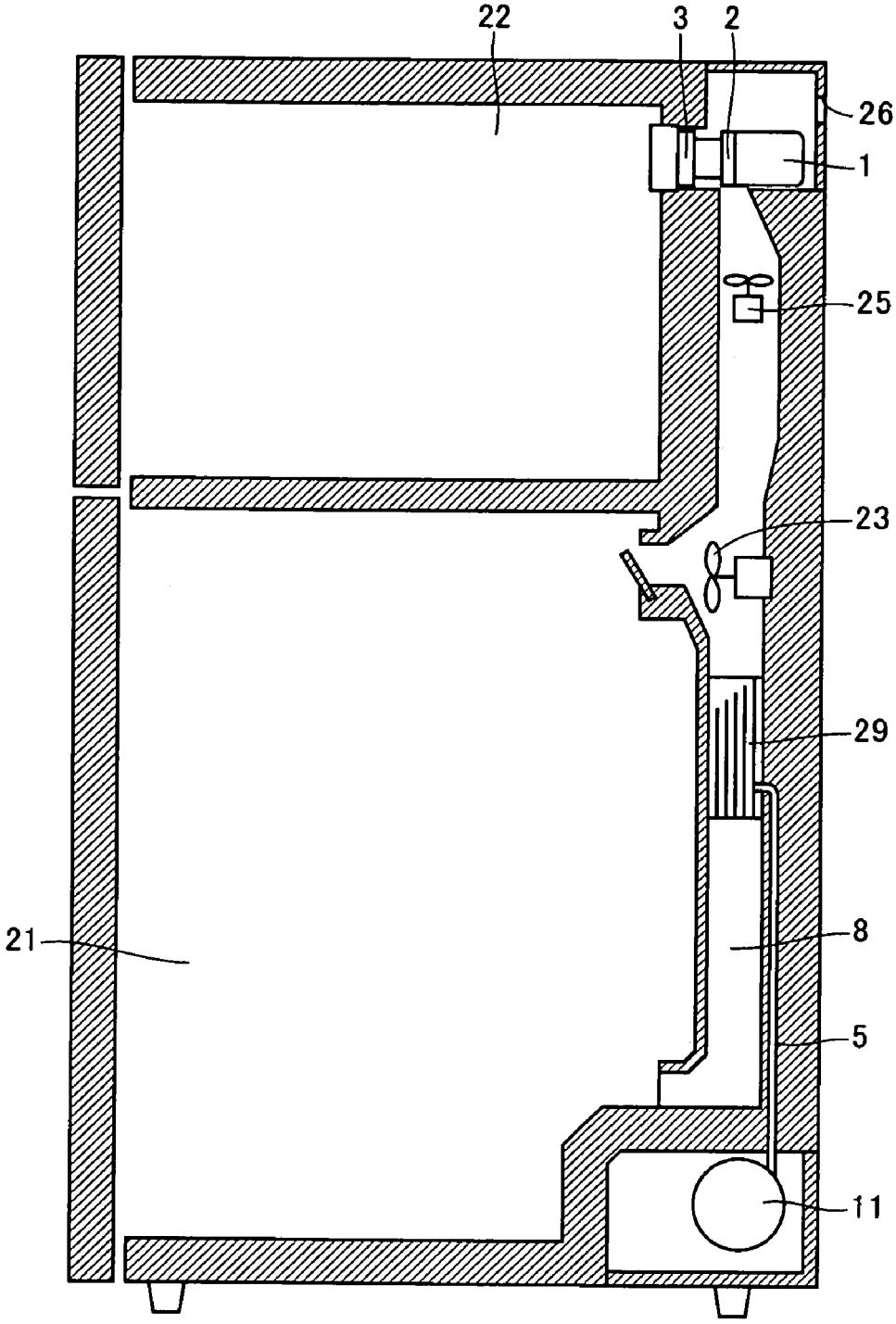
FIG.4 PRIOR ART
FIG. 4 is a schematic cross sectional view of a refrigerator according to a conventional art.

A refrigerator according to a second embodiment of the present invention will now be described with reference to FIG. 3. FIG. 3 illustrates a cooling circuit of the refrigerator of the present embodiment.

The refrigerator of the present embodiment is similar to the refrigerator of the first embodiment in that it includes cooling compartment evaporator 12 connected to compressor 11 and freezing compartment evaporator 4 connected to Stirling refrigerating machine 1. Positioning of compressor 11, Stirling refrigerating machine 1, cooling compartment evaporator 12 and freezing compartment evaporator 4 within the refrigerator is also similar to that of the first embodiment.

First circulation circuit 5 of the present embodiment includes a main circuit 7*a* and an auxiliary circuit 7*b*. Main circuit 7*a* is a circuit where the refrigerant circulates through compressor 11, heat radiators such as drain treatment refrigerant pipe 14, refrigerant expansion portion 13*a*, and cooling compartment evaporator 12. The first refrigerant coming out of cooling compartment evaporator 12 is returned directly to compressor 11. The inlet of auxiliary circuit 7*b* is connected to a three-way valve 20 serving as branch means that is formed in the piping of main circuit 7*a* on its way from compressor 11 to cooling compartment evaporator 12. The outlet of auxiliary circuit 7*b* is connected to main circuit 7*a* on its way from cooling compartment evaporator 12 back to compressor 11. Auxiliary circuit 7*b* includes an auxiliary refrigerant expansion portion 13*b* for expanding the first refrigerant in main circuit 7*a* while reducing its pressure, and a heat radiation portion cooling evaporator 19 that is in contact with high-temperature heat radiation portion 2 of Stirling refrigerating machine 1. Heat radiation portion cooling evaporator 19 is formed downstream of auxiliary refrigerant expansion portion 13*b*. Auxiliary circuit 7*b* is arranged on the backside of the refrigerator.

Three-way valve 20 serving as the branch means is formed between refrigerant condensation pipe 16 and refrigerant expansion portion 13*a*. Three-way valve 20 used herein is one having four modes allowing opening/closing of the side directed to cooling compartment evaporator 12 and the side directed to heat radiation portion cooling evaporator 19. Although three-way valve 20 used in the present embodiment enables only full opening and full closing in the respective directions, one capable of adjusting the degree of opening in each direction may also be employed.

Heat radiation portion cooling evaporator 19 is formed in contact with high-temperature heat radiation portion 2 to surround the same. A second circulation spiral portion 18 is formed around low-temperature heat absorption portion 3 of Stirling refrigerating machine 1, which is in a spiral shape in contact with low-temperature heat absorption portion 3 surrounding the same. Second circulation circuit 6, as in the case of the first embodiment, is formed such that the second refrigerant can circulate between second circulation spiral portion 18 and freezing compartment evaporator 4. In the present embodiment, HC refrigerant is used for the first refrigerant, and carbon dioxide is used for the second refrigerant, again as in the first embodiment.

The refrigerator according to the present embodiment includes control means for closing the side of three-way valve 20 directed to cooling compartment evaporator 12 when detecting that the temperature of cooling compartment 21 has become a set value or lower. Further, it includes control means for closing the side of three-way valve 20 directed to heat radiation portion cooling evaporator 19 when detecting that the temperature of freezing compartment 22 has become a set value or lower. It further includes control means for closing the side of three-way valve 20 directed to cooling compartment evaporator 12 and opening the side directed to heat radiation portion cooling evaporator 19 when detecting that the temperature of freezing compartment 22 has become a set value or higher. It also includes control means for causing cooling compartment cooling fan 23 to rotate by detecting the humidity of cooling compartment 21 in the state where the side directed to cooling compartment evaporator 12 is closed.

Otherwise, the configuration is identical to that of the first embodiment, and thus, description thereof will not be repeated here.

The first refrigerant compressed by compressor 11 is passed through the heat radiators such as drain treatment refrigerant pipe 14, reduced in pressure and expanded in refrigerant expansion portion 13*a*, and delivered to cooling compartment evaporator 12, as shown by an arrow 35. After evaporated in cooling compartment evaporator 12, the first refrigerant is returned to compressor 11, as shown by an arrow 36, where it is compressed again. Cooling takes place in cooling compartment evaporator 12 by latent heat of the first refrigerant, as in the case of the first embodiment. The functions and effects of second circulation circuit 6 are the same as those in the first embodiment.

A part of the first refrigerant is flown into auxiliary circuit 7*b* via three-way valve 20 formed between refrigerant condensation pipe 16 and refrigerant expansion portion 13*a*. The first refrigerant flowing into auxiliary circuit 7*b* is reduced in pressure and expanded in auxiliary refrigerant expansion portion 13*b*, and delivered to heat radiation portion cooling evaporator 19, where it is evaporated. The first refrigerant coming out of heat radiation portion cooling evaporator 19 merges with that in main circuit 7*a*, and returns to compressor 11.

The first refrigerant reduced in pressure and expanded in auxiliary refrigerant expansion portion 13*b* is in the two-phase state. When the relevant first refrigerant evaporates in heat radiation portion cooling evaporator 19; heat radiation portion cooling evaporator 19 attains a low temperature. High-temperature heat radiation portion 2 of Stirling refrigerating machine 1 is cooled, as heat radiation portion cooling evaporator 19 is in contact therewith. With this configuration, a part of the first refrigerant can be used to directly cool high-temperature heat radiation portion 2 of Stirling refrigerating machine 1, so that heat efficiency improves. This also improves the system COP. Further, high power output can be obtained even when low-temperature heat absorption portion 3 of Stirling refrigerating machine 1 is in the cryogenic state, making it possible to maintain the cryogenic cooling of freezing compartment 22 for a long period of time.

The branch means can readily be formed by employing three-way valve 20. Further, when the one capable of opening/closing the side directed to cooling compartment evaporator 12 and the side directed to heat radiation portion cooling evaporator 19 is employed, the flow of the first refrigerant toward cooling compartment evaporator 12 or to heat radiation portion cooling evaporator 19 can be blocked as required, which contributes to saving of power consumption. Although three-way valve 20 of the present embodiment is arranged between refrigerant condensation pipe 16 and refrigerant expansion portion 13*a*, not limited thereto, it may be arranged in any place of the piping between refrigerant expansion portion 13*a* and compressor 11. However, it is preferable that the first refrigerant is sufficiently cooled in the heat radiators before it reaches auxiliary refrigerant expansion portion 13*b*, and thus, the valve is preferably arranged downstream of the heat radiators such as refrigerant condensation pipe 15.

By provision of the control means for closing the side of three-way valve 20 directed to cooling compartment evaporator 12 upon detection of the temperature of cooling compartment 21 being not higher than a set value, cooling of cooling compartment 21 can be interrupted when it is unnecessary. This can lower the load of compressor 11, and thus, contributes to saving of power consumption. Similarly, by provision of the control means for closing the side of three-way valve 20 directed to heat radiation portion cooling evaporator 19 upon detection of the temperature of freezing compartment 22 being not higher than a set value, cooling of high-temperature heat radiation portion 2 of Stirling refrigerating machine 1 can be interrupted when it is unnecessary to cool freezing compartment 22. It can lower the load of compressor 11, again contributing to saving of power consumption.

Further, the refrigerator of the present embodiment includes the control means for closing the side of three-way valve 20 directed to cooling compartment evaporator 12 and opening the side directed to heat radiation portion cooling evaporator 19 when the temperature of freezing compartment 22 has become a set value or higher in the case where the door of freezing compartment 22 is left open for a long period of time or the like. Provision of this control means enables interruption of the flow of the first refrigerant toward cooling compartment evaporator 12, so that the cooling capacity of the first refrigerant is entirely used for cooling high-temperature heat radiation portion 2 of Stirling refrigerating machine 1. In this manner, high-temperature heat radiation portion 2 of Stirling refrigerating machine 1 can be cooled with a lower temperature. This can increase the cooling capacity of low-temperature heat absorption portion 3 of Stirling refrigerating machine 1, and as a result, it is possible to quickly cool freezing compartment 22.

Further, the refrigerator of the present embodiment includes the control means for causing cooling compartment cooling fan 23 to rotate by detecting the humidity of cooling compartment 21 in the state where the side of three-way valve 20 directed to cooling compartment evaporator 12 is closed. When cooling of cooling compartment 21 is unnecessary, cooling compartment cooling fan 23 is caused to rotate to increase the temperature of cooling compartment evaporator 12. As such, the frost settled over cooling compartment evaporator 12 is partially evaporated, to humidify cooling compartment 21.

Further, when the frost is settled around cooling compartment evaporator 12 as its temperature becomes too low, the number of revolutions of compressor 11 is decreased and the output of Stirling refrigerating machine 1 is increased for defrosting, as in the case of the first embodiment. Still further, the control means for detecting the outside air temperature and the temperature of cooling compartment 21 and for controlling the number of revolutions of compressor 11 in response to the outside air temperature and the temperature of the cooling compartment is provided, again as in the case of the first embodiment.

The other functions and effects are identical to those of the first embodiment, and thus, description thereof will not be repeated here.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is applicable to a refrigerator incorporating a Stirling refrigerating machine and a compressor.

The invention claimed is:

1. A refrigerator, comprising:

a Stirling refrigerating machine having a high-temperature heat radiation portion and a low-temperature heat absorption portion and cooling a freezing compartment; and a compressor for circulating a first refrigerant through a first circulation circuit including a cooling compartment evaporator; wherein said high-temperature heat radiation portion is in physical contact with said first circulation circuit.

2. The refrigerator according to claim 1, wherein said high-temperature heat radiation portion is in contact with piping of said first circulation circuit on its way from said cooling compartment evaporator back to said compressor.

3. The refrigerator according to claim 1, wherein said high-temperature heat radiation portion is in contact with a heat radiation portion cooling evaporator that is formed in said first circulation circuit on its way from said cooling compartment evaporator back to said compressor.

4. The refrigerator according to claim 1, comprising:

a cooling compartment cooling fan for transferring cold heat of said cooling compartment evaporator to a cooling compartment; and control means for stopping said cooling compartment cooling fan when detecting that a temperature of said freezing compartment has become a set value or higher.

5. The refrigerator according to claim 1, wherein said first circulation circuit includes a main circuit and an auxiliary circuit, said auxiliary circuit has an auxiliary refrigerant expansion portion and a heat radiation portion cooling evaporator formed downstream of said auxiliary refrigerant expansion portion, and has its inlet connected to branch means that is formed in piping of said main circuit on its way from said compressor to said cooling compartment evaporator, and said high-temperature heat radiation portion is in contact with said heat radiation portion cooling evaporator.

6. The refrigerator according to claim 5, wherein a three-way valve capable of opening/closing its side directed to said cooling compartment evaporator and its side directed to said heat radiation portion cooling evaporator is arranged as said branch means.

7. The refrigerator according to claim 6, comprising control means for closing the side of said three-way valve directed to said cooling compartment evaporator when detecting that a temperature of a cooling compartment has become a set value or lower.

8. The refrigerator according to claim 6, comprising control means for closing the side of said three-way valve directed to said heat radiation portion cooling evaporator when detecting that a temperature of said freezing compartment has become a set value or lower.

9. The refrigerator according to claim 6, comprising control means for closing the side of said three-way valve directed to said cooling compartment evaporator and opening the side of said three-way valve directed to said heat radiation portion cooling evaporator when detecting that a temperature of said freezing compartment has become a set value or higher.

10. The refrigerator according to claim 6, comprising:

a cooling compartment cooling fan for transferring cold heat of said cooling compartment evaporator to a cooling compartment; and control means for causing said cooling compartment cooling fan to rotate by detecting humidity of said cooling compartment in the state where the side of said three-way valve directed to said cooling compartment evaporator is closed.

11. The refrigerator according to claim 1, comprising control means for decreasing the number of revolutions of said compressor and increasing output of said Stirling refrigerating machine when detecting that a temperature of said cooling compartment evaporator has become a set value or lower.

12. The refrigerator according to claim 1, comprising control means for controlling the number of revolutions of said compressor in response to an outside air temperature and a temperature of a cooling compartment.

* * * * *